United States Patent [19]

Arndt

[11] 4,348,193

[45] Sep. 7, 1982

[54] FOOT STEERING APPARATUS FOR OUTBOARD MOTOR BOATS

[76] Inventor: Walter E. Arndt, 1713 Third Ave. South, Fargo, N. Dak. 58102

[21] Appl. No.: 143,645

[22] Filed: Apr. 25, 1980

[51] Int. Cl.[3] ..... B63H 25/02

[52] U.S. Cl. ..... 440/62; 114/153

[58] Field of Search ..... 440/53, 62; 114/144 R, 114/153, 160, 144 A; 74/470, 478, 478.5, 480 B, 494, 517

[56] References Cited

U.S. PATENT DOCUMENTS

| | | | |
|---|---|---|---|
| 235,823 | 12/1880 | Statts . | |
| 1,371,911 | 3/1921 | Compte | 74/494 |
| 2,507,894 | 5/1950 | Dorn et al. . | |
| 2,668,513 | 2/1954 | Reynolds . | |
| 2,726,622 | 12/1955 | Daniels . | |
| 2,749,872 | 6/1956 | Amick . | |
| 2,757,630 | 8/1956 | Ottinger . | |
| 2,829,616 | 4/1958 | O'Brien et al. . | |
| 3,007,429 | 11/1961 | Sandman | 114/160 |
| 3,844,243 | 10/1974 | Caton et al. | 114/153 |
| 4,022,145 | 5/1977 | Tindal . | |

FOREIGN PATENT DOCUMENTS

| | | | |
|---|---|---|---|
| 627100 | 9/1961 | Canada | 114/153 |

*Primary Examiner*—Trygve M. Blix
*Assistant Examiner*—Stephen P. Avila
*Attorney, Agent, or Firm*—Burd, Bartz & Gutenkauf

[57] ABSTRACT

A foot operable apparatus for steering an outboard motor powered boat to leave the hands of the boatman free to tend to other tasks. The apparatus has a frame disposed on the floor of the boat and carrying a turntable forward of the motor and rotatable about a generally upright axis. A cable assembly extends from the turntable and has ends connected to the motor such that turning of the turntable is effective to turn the motor. Foot pedals are associated with the turntable such that the turntable can be rotated by the feet of the boatman.

20 Claims, 7 Drawing Figures

2
2
10
11
12
15
16
17
18
20
21
22
23
24
26
27
28
32
33
34
35
37
38
39
41
42
44
45
48
49
50
54
55
56
58A
58B
60
61
62
63
65
66

10
11
12
13
15
16
17
20
21
23
26
32
35
38
41
42
43
44
49
50
51
52
54
55
58A
59
60
65
66

Fig. 3
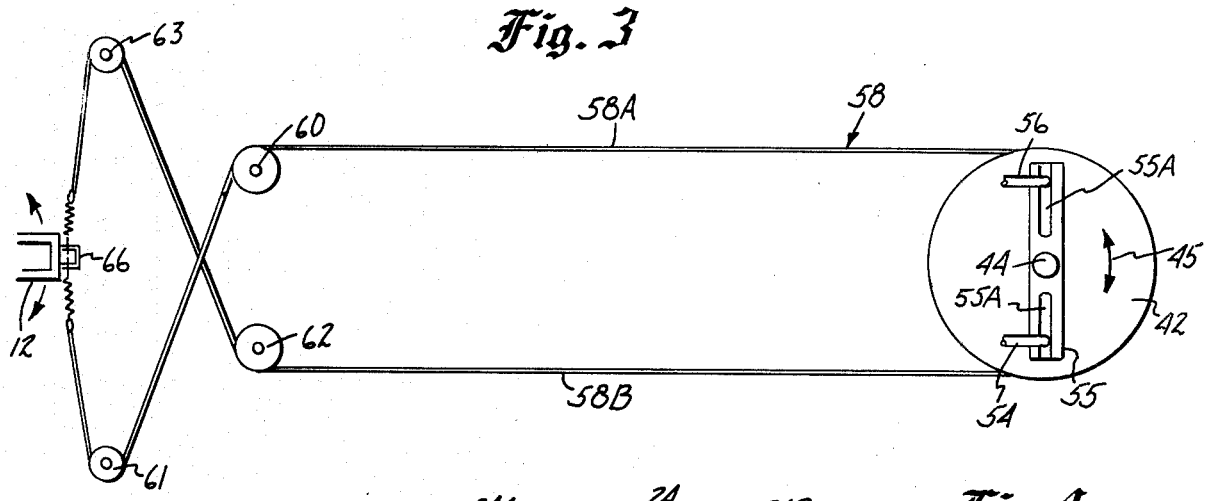
Fig. 4
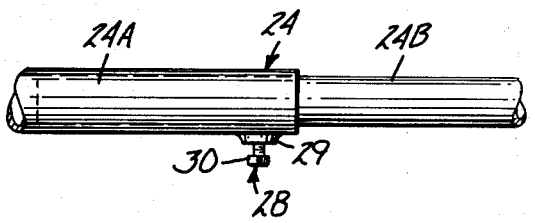
Fig. 5
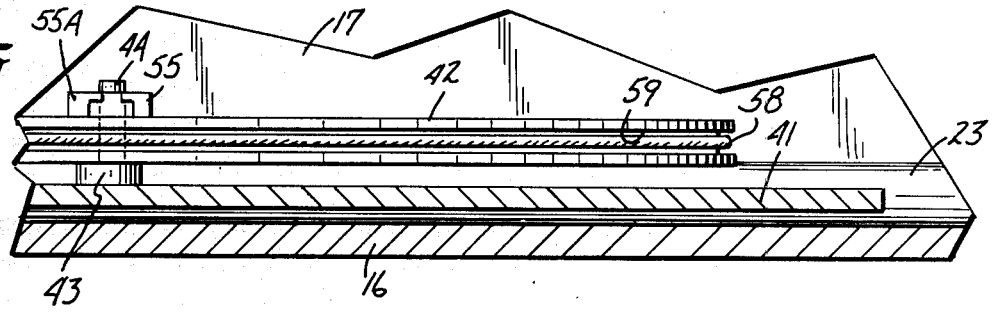
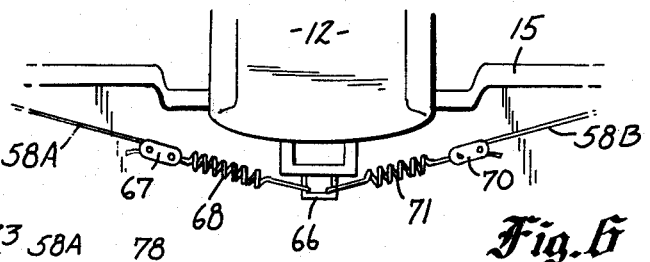
Fig. 6
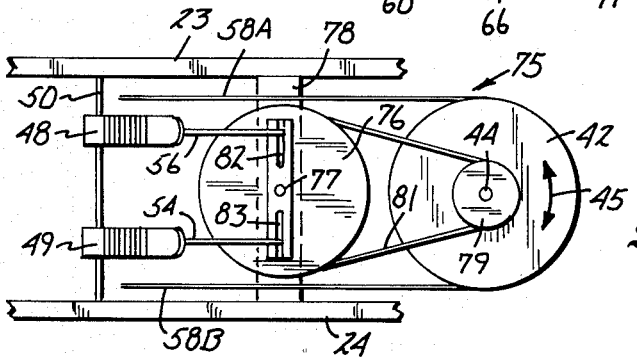
Fig. 7

FOOT STEERING APPARATUS FOR OUTBOARD MOTOR BOATS

SUMMARY OF THE INVENTION

Fishing boats and other outboard motor powered boats are frequently steered from behind by rotation of the motor upon turning of the conventional steering arm associated with the motor. This puts the fisherman or other boat man in awkward position of reaching at least partially rearward to steer the boat. It also occupies his hands to the exclusion of other activities such as tending fishing equipment.

The invention pertains to a foot operated steering apparatus for steering a boat having an outboard motor mounted on a transom thus to free the hands of the fisherman or boatman to perform other activity and also to enable the boatman to position himself more centrally in the boat if desired.

The apparatus includes a pair of longitudinal parallel spaced apart side frame members positioned on the floor or bottom of the boat. A platform is fastened to the side frame members and carries a horizontally disposed rotatable turntable. A steering cable is trained over a grooved rim of the turntable, extending rearwardly therefrom and eventually connected to the outboard motor. Foot pedals are rotatably mounted to a cross member extending between the longitudinal frame members and are associated with the turntable such that the depression of either a right or a left foot pedal by a fisherman seated on a boat seat is operative to turn the turntable and pull the steering cable to turn the boat in either a right or a left direction. The length of the side frame members is adjustable for installation in different lengths of boats. An adjustable rear cross brace assists in holding the frame members in place with respect to the boat.

IN THE DRAWINGS

FIG. 3 is a schematic diagram of the steering cable system of the foot operated steering apparatus of FIG. 1;

FIG. 4 is an enlarged fragmentary view of a portion of a side frame member of the foot operated steering apparatus of FIG. 1;

FIG. 5 is another enlarged fragmentary view of a portion of the foot operated steering apparatus of FIG. 1;

FIG. 6 is an enlarged top elevational view showing the connection of the steering cable to the outboard motor of the foot operated steering apparatus of FIG. 1; and FIG. 7 is a modification of the foot drive of the steering apparatus.

DESCRIPTION OF PREFERRED EMBODIMENT

Figure 1:
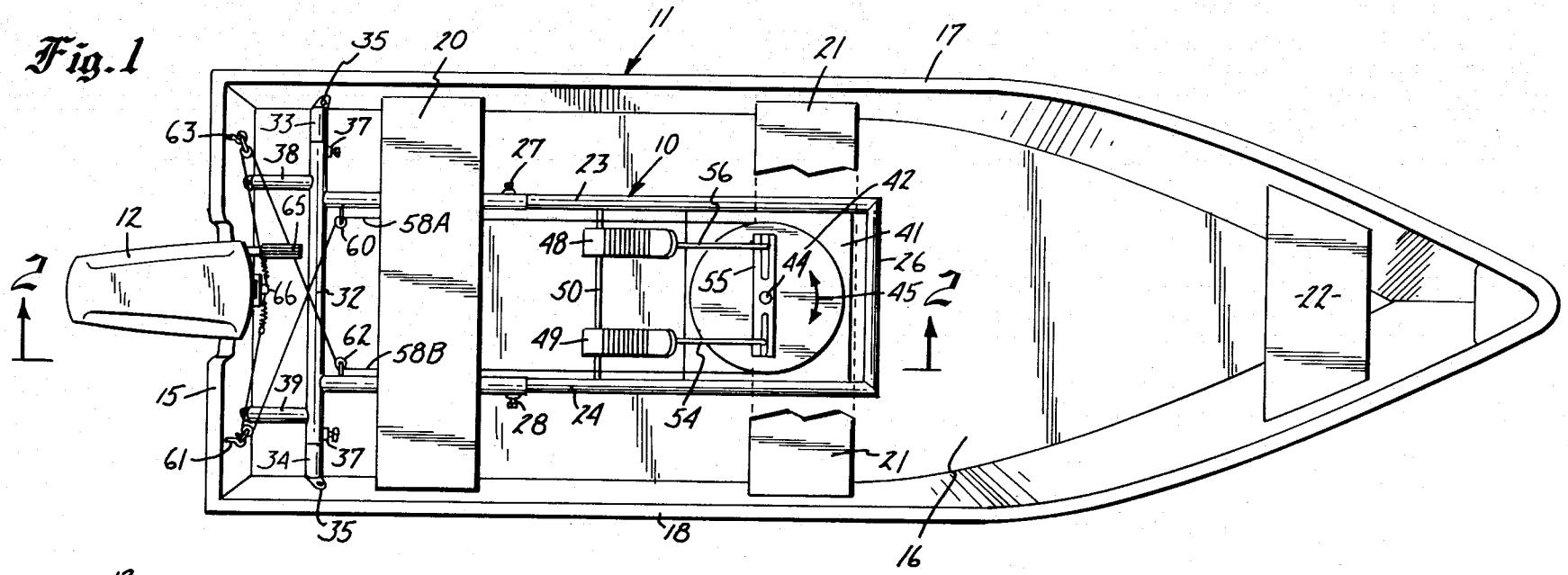
FIG. 1 is a top elevational view of a boat and outboard motor equipped with a foot operated steering apparatus of the invention.
Figure 2:
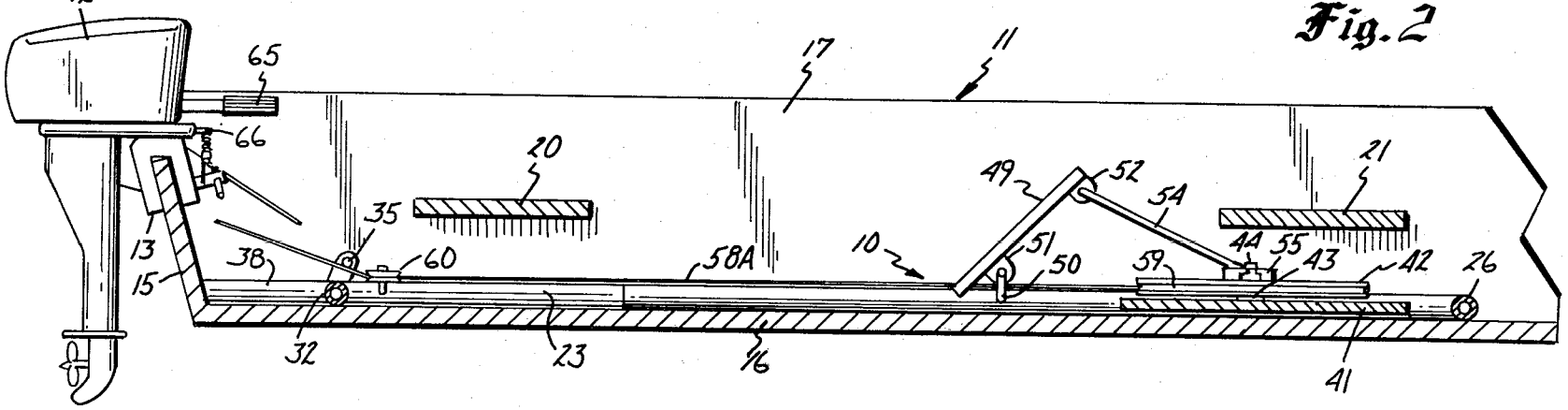
FIG. 2 is an enlarged fragmentary sectional view of the boat shown in FIG. 1 taken along the line 2—2 thereof.

Referring to the drawings, there is shown in FIGS. 1 and 2 a foot operated steering apparatus indicated generally at 10 according to the present invention installed in a boat 11 of the type propelled by outboard motor 12 fixed by motor clamps 13 on the transom 15 of boat 11. Outboard motor 12 propels boat 11 through the water and boat 11 is steered by rotation of outboard motor 12 relative to clamp assembly 13 about a generally upright axis in a direction opposite the intended direction of travel of boat 11. Boat 11 has a floor or bottom 16 joined to upwardly extended longitudinal sides 17, 18. A plurality of transverse seats 20, 21, 22 span the beam of boat 11 and are interiorly connected to sides 17, 18. A fisherman or other boat person can sit on one of the seats 20 and manipulate the foot operated steering apparatus 10 to turn the outboard motor 12 and steer boat 11 while having free hands for performing other functions.

Steering apparatus 10 includes a pair of first and second longitudinal, parallel spaced apart side frame members 23, 24 located on floor 16 of boat 11 extended from proximate the stern thereof to an intermediate location along the center line of boat 11. Forward ends of frame members 23, 24 are connected by a cross member 26. Frame members 23, 24 can be comprised of telescopically engaged tubular sections so as to be extendable and retractable in length and held in position by clamp assemblies 27, 28. As shown in FIG. 4, second frame member 24 includes a first hollow tubular section 24A and a second tubular section 24B telescopically engaged in the forward end of the first tubular member 24A. Clamp assembly 28 includes a nut 29 secured to the surface of the first tubular section 24A near the end thereof. A bolt 30 is threaded into the nut 29 and through a corresponding opening provided in the first tubular section 24B engaged therein to hold it in place. Bolt 30 is readily releasable for adjustment of the length of frame member 24. First frame member 23 is likewise adjustable.

The aft or rearward ends of side frame members 23, 24 are connected as by welding or the like to a tubular cross brace 32. Cross brace 32 comprises an open ended tubular member disposed transversely of the center line of bolt 11 and has legs 33, 34 telescopically engaged in either end and extending outward thereof. The legs 33, 34 terminate and feet 35 to bear against the inside surfaces of sidewalls 17, 18 of bolt 11. Clamp assemblies 37 located on the cross brace 32 are effective to clamp or lock the outwardly extended position of the legs 33, 34 with the feet 35 bearing against the interior surfaces of the boat walls 17, 18 to facilitate holding the frame members 23, 24 in place. Longitudinal brace members 38, 39 are connected to cross brace 32 and extended rearwardly therefrom to a point in surface engagement with the interior surface of transom 15 to further inhibit rearward movement of longitudinal side frame members 23, 24.

A horizontal plate or platform 41 is disposed between side frame members 23, 24 toward the forward ends thereof and is suitably secured to them as by welding. A circular, horizontal turntable 42 is rotatably mounted on the upper surface of platform 41. Referring to FIG. 5, platform 41 carries a suitable bearing assembly 43. A shaft 44 extends from the bearing assembly 43 and is centrally secured to the turntable 42 for rotational movement of turntable 42 about a generally vertical axis as indicated by the arrow 45 in FIG. 1.

A pair of first and second or left and right foot pedals 48, 49 are provided for rotation of turntable 42. A transverse mounting rod 50 is disposed between the longitudinal side frame members 23, 24 a distance slightly behind platform 41. As shown in FIG. 2, right foot pedal 49 has a rearward boss 51 secured to its lower surface and in pivotal engagement with the mounting rod 50.

Foot pedal 49 is orientated in an upwardly inclined disposition and has a forward boss 52 mounted on its forward lower surface. Forward boss 52 is pivotally connected to one end of a foot pedal link 54. A transverse steering arm 55 is secured to turntable 42 and extends laterally across its upper surface. The opposite end of foot pedal link 54 is pivotally connected to one end of the transverse steering arm 55. Depression of foot pedal 49 is effective to rotate the turntable 42 in a counterclockwise direction as viewed in FIG. 1. In similar fashion, the left foot pedal 48 is connected by another foot pedal link 56 to the opposite end of the transverse steering arm 55 on the opposite side of the axis of rotation of turntable 42 such that depression of the left foot pedal 48 is effective to rotate the turntable 42 in a clockwise direction as viewed in FIG. 1. As shown in FIG. 5, arm 55 has an undercut groove 55A. Links 54 and 56 have heads that fit into the groove 55A to pivotally connect the links to the arm.

A steering cable 58 is trained around the forward perimeter of turntable 42 and extends rearwardly from either side of turntable 42. The perimeter of rim of turntable 42 is provided with a groove 59 for accommodation of cable 58 (see FIG. 5). Cable 58 extends tangentially from either side of turntable 42 rearwardly and parallel to side frame members 23, 24. One side 58A of cable 58 extends proximate and parallel to the first frame member 23 and is trained through a first pulley 60 fixed to the aft end of frame member 23. Cable side 58A extends from pulley 60 to a second pulley 61 fixed to the transom 15 on the opposite side of the center line of boat 11 with respect to the first pulley 60. Cable side 58A is trained through pulley 61 and then extends to motor 12. The second side 58B of cable 58 extends tangentially from turntable 42 proximate to and parallel to the second side frame member 24 and is trained through a third pulley 62 fastened to the aft end of the second side frame member 24. Cable side 58B extends from the third pulley 62 to a fourth pulley 63 fastened to the transom 15 of boat 11 and located on the opposite side of the center line of boat 11 relative to the third pulley 62. Cable sides 58A, 58B cross one another proximate the center line of boat 11 and proximate motor 12. Second cable side 58B is trained through the fourth pulley 63 and then extends to the motor 12.

Referring to FIG. 6, motor 12 has a conventional handle 65 having a closed loop clip 66 attached thereto. The end of cable side 58A is fastened to a first cable clamp 67. Cable clamp 67 is of a conventional releasable variety whereby the length of cable 58A can be adjusted. Cable clamp 67 is attached to a first tension spring 68 having a hooked end. The hooked end of tension spring 68 engages the clip 66 on handle 65. Second cable side 58B is fastened to a second cable clamp 70. Second cable clamp 70 is attached to a second tension spring 71 having a hooked end which is also engaged in the clip 66. Adjustment of the length of cable sides 58A, B so that there is tension in tension spring 68, 71 is effective to put a desired amount of tension in steering cable 58.

In use, a boatman is seated on seat 20 with feet engaging the foot pedals 48, 49 while motor 12 is operating. Depression of the right foot pedal 49 is effective to turn the boat in a right hand direction. As can be seen schematically in FIG. 3, depression of the right foot pedal 49 is effective to rotate turntable 42 in a counterclockwise direction as viewed in FIG. 3. This pulls the second side of 58B of cable 58, and through third and fourth pulleys 62, 63, the motor 12 is rotated in counterclockwise direction as viewed in FIG. 3. This is effective to turn boat 11 to the right. Depression of the left foot pedal 48 in like fashion is effective to turn the boat 11 to the left. The steering apparatus 10 is readily removable from boat 11 for placement in another boat. The frame members 23, 24 are adjustable in length so as to be fitted in boats of varying lengths. Likewise, the legs 33, 34 of cross brace 32 are extendable and retractable so as to be able to fit in boats of varying widths.

A modification of the foot power transmission assembly or drive, indicated generally at 75, is shown in FIG. 7. Assembly 75 has a first disc or pulley 76 rotatably mounted on an axle or fixed shaft 77. Axle 77 is secured to a cross plate 78 secured to frame members 23 and 24. A second disc or pulley 79 rotatable mounted on shaft 44 is secured to turntable 42. Pulley 79 has a diameter of about one-half of the diameter of pulley 76. Other size ratios between pulleys 76 and 79 can be used. A cable 81 is trained about pulleys 76 and 79 drivably connects the pulleys. A gear drive can drivably connect pulley 76 with pulley 79. Foot pedals 48 and 49 pivotally mounted on transverse rod 50 are connected to links 56 and 54, respectively. The forward ends of links 54 and 56 are located in grooves 82 and 85 in opposite sections of pulley 76. The links 54 and 56 are pivotally connected to pulley 76 so that the foot pedals 48 and 49 when depressed selectively rotate pulley 76 in opposite directions. Cable 81 transmits this rotational movement to small pulley 79 with an increase in torque. Pulley 42 moves cable 58 which turns motor 12.

While there has been shown and described several embodiments of a steering apparatus according to the invention, it will be apparent that variations and deviations can be had from the embodiments shown without departing from the scope and spirit of the invention.

The embodiments of the invention in which an exclusive property or privilege is claimed are defined as follows:

1. A foot operable steering apparatus to steer a boat equipped with an outboard motor mounted on a transom at the back of the boat and rotatable about a generally upright axis for purposes of steering the boat, said steering apparatus comprising:

frame means locatable on the floor of the boat;

a turntable secured with respect to the frame means forward of said motor and rotatable about a generally upright axis;

a steering cable trained around the turntable and having ends extending tangentially from either side of the turntable rearwardly therefrom and connected to the motor whereby rotation of the turntable in one direction rotates the motor in one direction to turn the boat in one direction, and rotation of the turntable in the opposite direction rotates the motor in the opposite direction to turn the boat in the opposite direction; and first and second foot pedals connected to the frame means and connected to the turntable on opposite sides of the axis of rotation of the turntable, said foot pedals each having a rearward end pivotally connected to the frame means for rotation about a generally horizontal axis, a first foot pedal connecting link connected to the forward end of the first foot pedal at one end and connected at the opposite end to said turntable, and a second foot pedal connecting link connected at one end to the forward end of the second foot pedal and connected at the other end to the turntable on the opposite side of the axis of rotation with respect to the first foot pedal connecting link whereby operation of one foot pedal is effective to rotate the turntable in one direction and operation of the other foot pedal is effective to rotate the turntable in the opposite direction.

2. The steering apparatus of claim 1 wherein: said frame means includes first and second longitudinal side frame members disposed along the bottom of said boat, a horizontal platform connected between the first and second side frame members forward of the motor, and means rotatably mounting said turntable on said platform.

3. The steering apparatus of claim 2 wherein: said frame means includes a mounting rod extending transversely between the first and second side frame members rear of said turntable, said foot pedals each having a rearward end pivotally connected to the mounting rod.

4. The steering apparatus of claim 2 or 3 wherein: said first and second frame members are each comprised of telescoping sections so as to be adjustable in length.

5. The steering apparatus of claim 2 wherein: said frame includes a tubular cross brace assembled to the rearward ends of the first and second frame members, a leg telescopically engaged in each end of said cross brace and extendable outward for engagement with the sidewall of the boat to hold the first and second frame members in place, and clamp means to secure the position of the legs with respect to the cross brace.

6. The steering apparatus of claim 5 wherein: said first and second frame members are each comprised of telescoping sections so as to be adjustable in length.

7. The steering apparatus of claim 2 wherein: said turntable has a grooved peripheral rim to accommodate the steering cable; and including a first pulley fastened to the first frame member proximate the rearward end thereof, a second pulley fastened to the transom of the boat on the opposite side of the center line of the boat from the first pulley, a third pulley fastened to the second frame member proximate the rearward end thereof, and a fourth pulley fastened to the transom of the boat on the opposite side of the boat from the third pulley, said cable having a first end extended parallel to the first frame member and trained through said first pulley and extended therefrom toward said second pulley and being trained through said second pulley and extending therefrom to the motor and being fastened to the motor; and a second side extended from the opposite side of said turntable parallel to the second frame member and being trained through the third pulley and extending from the third pulley to the fourth pulley and being trained through the fourth pulley and extending from the fourth pulley to the motor and being fastened to the motor.

8. The steering apparatus of claim 7 wherein: said frame means includes a mounting rod extended transversely between the first and second frame members and secured thereto, each foot pedal having a rearward end pivotally connected to the mounting rod.

9. The steering apparatus of claim 7 or 8 wherein: said first and second frame members are comprised of telescoping sections so as to be adjustable in length.

10. The steering apparatus of claim 7 or 8 wherein: said frame includes a tubular cross brace assembled to the rearward ends of the first and second frame members, a leg telescopically engaged in each end of said cross brace and extendable outward for engagement with the sidewall of the boat to hold the first and second frame members in place, and clamp means to secure the position of the legs with respect to the cross brace.

11. The steering apparatus of claim 10 wherein: said first and second frame members are each comprised of telescoping sections so as to be adjustable in length.

12. The apparatus of claim 1 including: drive means connecting the foot pedals to the turntable, said drive means including a first pulley rotatably mounted on a fixed shaft, a second pulley secured to the turntable, and means drivably connecting the first and second pulleys.

13. The apparatus of claim 12 wherein: the second pulley is smaller than the first pulley.

14. A foot operable steering apparatus to steer a boat equipped with an outboard motor, a floor, and transverse seat means, said outboard motor being rotatable about a generally upright axis to steer the boat, comprising:

frame means locatable in the boat on the floor thereof;

pivotally movable means, means movably mounting the pivotally movable means on the frame means for pivotal rotation about an upright axis;

said frame means including side members disposed along the bottom of said boat, and a platform connected to said side members, said means movably mounting the movable means including pivot means rotatably mounting the movable means on the platform, said side members each having sections that can be adjusted relative to each other to change the length thereof;

cable means connected to the pivotally movable means and adapted to be connected to the outboard motor; and means connected to the movable means positioned for engagement by the feet of a boat operator seated on the transverse seat means operable to transmit force from a foot of a person to said movable means to pivotally move said movable means and to move said cable means whereby the outboard motor is turned relative to the boat to steer the boat.

15. The steering apparatus of claim 14 wherein: the movable means is a circular turntable having an outer peripheral portion in driving engagement with a portion of said cable means.

16. The steering apparatus of claim 15 wherein: said outer peripheral portion of the turntable has a groove, said portion of the cable means being located in said groove.

17. The steering apparatus of claim 14 wherein: said means connected to the movable means include foot pedal means movably mounted on the frame means.

18. A foot operable steering apparatus to steer a boat equipped with an outboard motor, a floor, and transverse seat means, said outboard motor being rotatable about a generally upright axis to steer the boat, comprising:

frame means locatable in the boat on the floor thereof;

pivotally movable means, means movably mounting the pivotally movable means on the frame means for pivotal rotation about an upright axis:

cable means connected to the pivotally movable means and adapted to be connected to the outboard motor; and foot pedal means movably mounted on the frame means connected to the movable means positioned for engagement by the feet of a boat operator seated on the transverse seat means operable to transmit force from a foot of a person to said movable means to pivotally move said movable means and to move said cable means whereby the outboard motor is turned relative to the boat to steer the boat, said foot pedal means comprised as a pair of foot pedals pivotally connected to the frame means and the movable means.

19. A foot operable steering apparatus to steer a boat equipped with an outboard motor, a floor, and transverse seat means, said outboard motor being rotatable about a generally upright axis to steer the boat, comprising:

frame means locatable in the boat on the floor thereof;

pivotally movable means, means movably mounting the pivotally movable means on the frame means for pivotal rotation about an upright axis;

cable means connected to the pivotally movable means and adapted to be connected to the outboard motor;

means connected to the movable means positioned for engagement by the feet of a boat operator seated on the transverse seat means operable to transmit force from a foot of a person to said movable means to pivotally move said movable means and to move said cable means whereby the outboard motor is turned relative to the boat to steer the boat;

said means connected to the movable means including foot operated means, drive means connecting the foot operated means to said movable means, said drive means including a first means rotatably mounted on a fixed shaft, a second means secured to the movable means, and means drivably connecting the first means and second means.

20. The apparatus of claim 19 wherein: the first and second means are first and second pulleys, said second pulley being smaller than the first pulley.

* * * * *

UNITED STATES PATENT AND TRADEMARK OFFICE

CERTIFICATE OF CORRECTION

PATENT NO. : 4,348,193

DATED : September 7, 1982

INVENTOR(S) : Walter E. Arndt

It is certified that error appears in the above–identified patent and that said Letters Patent are hereby corrected as shown below:

Column 3, line 22, "of rim" should be --or rim--.

Column 4, line 16, "rotatable" should be --rotatably--.

Column 4, line 25, "85" should be --83--.

Signed and Sealed this

*First* Day of *February 1983*

[SEAL]

*Attest:*

GERALD J. MOSSINGHOFF

*Attesting Officer*

*Commissioner of Patents and Trademarks*